US012018506B1

(12) United States Patent
Lo et al.

(10) Patent No.: US 12,018,506 B1
(45) Date of Patent: Jun. 25, 2024

(54) HIDDEN INTERCONNECTION ARRANGEMENT OF FENCE OR RAILING AND ASSEMBLING METHOD THEREOF

(71) Applicants: Eric Chen Zer Lo, Tainan (TW); Chong-Yi Lo, Tainan (TW)

(72) Inventors: Eric Chen Zer Lo, Tainan (TW); Chong-Yi Lo, Tainan (TW)

( * ) Notice: Subject to any disclaimer, the term of this patent is extended or adjusted under 35 U.S.C. 154(b) by 0 days.

(21) Appl. No.: 18/529,089

(22) Filed: Dec. 5, 2023

(51) Int. Cl.
*E04H 17/14* (2006.01)

(52) U.S. Cl.
CPC ..... *E04H 17/1478* (2021.01); *E04H 17/1465* (2021.01)

(58) Field of Classification Search
CPC . E04H 17/14; E04H 17/1413; E04H 17/1417; E04H 17/1426; E04H 17/1439; E04H 17/1465; E04H 17/1469; E04H 17/1478; E04H 17/1488
See application file for complete search history.

(56) References Cited

U.S. PATENT DOCUMENTS 5,454,548 A * 10/1995 Moore ..... E04H 17/1447 256/65.16
6,375,166 B1 * 4/2002 Schall ..... E04H 17/1439 256/59
6,824,123 B2 * 11/2004 Larsen ..... E04H 17/1439 256/65.12
6,863,265 B2 * 3/2005 Perry ..... E04H 17/1488 256/22
7,384,025 B2 * 6/2008 Lo ..... E04H 17/1439 256/65.13
7,677,535 B1 * 3/2010 Lo ..... E04H 17/1439 256/65.01
8,356,801 B2 * 1/2013 Howard ..... E04H 17/1439 256/22
8,695,948 B2 * 4/2014 Stinson ..... E04F 11/1817 256/64
8,695,949 B2 * 4/2014 Stinson ..... E04H 17/143 256/64
9,404,283 B1 * 8/2016 Lo ..... E04H 17/1439
10,060,155 B2 * 8/2018 Molina ..... E04F 11/1817
10,533,340 B1 * 1/2020 Ohanesian ..... E04H 17/1417
10,648,194 B2 * 5/2020 Lo ..... E04H 17/1439
11,746,558 B2 * 9/2023 Lo ..... E04H 17/1439 256/1

(Continued)

*Primary Examiner* — Jonathan P Masinick
(74) *Attorney, Agent, or Firm* — Raymond Y Chan; David & Raymond Patent Firm

(57) ABSTRACT

A hidden interconnection arrangement of fence or railing includes two or more engaging rails, a plurality of fasteners configured to pass through position holes of the engaging rails and fasten to fastening holes of a plurality of upright posts, and a pair of upper engaging arm and lower engaging arm integrally protruded from an inner surface of an engaging wall of a lateral beam, defining an engaging recess therebetween. A downward force applied to a top wall of the lateral beam is able to press a bottom guider edge of the lower engaging arm downwards against a top edge of the engaging rail that generates a reaction force to enlarge the bottom opening of the lateral beam to allow the engaging rail to be engaged in the engaging recess and locked between the upper engaging arm and the lower engaging arm of the lateral beam.

10 Claims, 12 Drawing Sheets

(56) References Cited

U.S. PATENT DOCUMENTS

| | | | | |
|---|---|---|---|---|
| 2004/0188663 | A1* | 9/2004 | Stein | E04H 17/1439 256/59 |
| 2007/0158630 | A1* | 7/2007 | Lo | E04F 11/181 256/59 |
| 2009/0166599 | A1* | 7/2009 | Lo | E04H 17/1417 256/65.01 |
| 2011/0001105 | A1* | 1/2011 | Lo | E04H 17/1447 256/65.08 |
| 2013/0264532 | A1* | 10/2013 | Goodman | E04H 17/1439 256/65.03 |

* cited by examiner

HIDDEN INTERCONNECTION ARRANGEMENT OF FENCE OR RAILING AND ASSEMBLING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to fences or railings, and more particularly to a hidden interconnection arrangement of fences or railings and assembling method thereof, wherein the lateral beams and upright posts are interconnected in a hidden manner without exposing the connection elements.

Description of Related Arts

Conventional metal fences or railings comprises lateral beams and upright rubes crossingly assembled with screws for tightly combining together, as shown in FIG. 1 to FIG. 2C. The fence 1 is made up of a plurality of lateral beams 10 and a plurality of upright posts 11 crossing with one another, and the crossing point of each lateral beam 10 with each upright post 11 is tightly secured with a screw 12 screwing through the both. Referring to FIG. 2A to FIG. 2C, the screws are used at every crossing points of the lateral and the upright posts 10 and 11 for forming a complete fence 1. However, it is very evident that the screws 12 have their heads exposed and protruding out on the surface of each lateral beam 10 resulting in a reduction of beauty and decency of the fence 1.

U.S. Pat. No. 5,557,893 discloses a railing assembly comprising a plurality of pickets and a plurality of inserts having a length corresponding to the distance between a picket, wherein the picket end portions are engagable within corresponding partial circular cutouts formed within the inserts, and the combination is receivable in the railing channel. However, fasteners are still needed to fixedly secure the insert and picket end within the channel at a predefined angular orientation and exposed outside.

U.S. Pat. No. 6,752,385 discloses a railing system comprising a plurality of first longitudinal rail portions defining channels to be fastened with pickets with fasteners at spaced intervals, wherein the second longitudinal rail portion is fittable onto the first longitudinal rail portion to form the assembled rail member with the channel and fasteners concealed within eh interior of the assembled rail member. This configuration successfully hide and conceal the fasteners but almost double the cost of the railing system since each rail is substantially constituted by a pair of first and second longitudinal rail portions.

U.S. Pat. No. 7,384,025, invented by the inventor of the present inventor, provides a solution to the drawback of the '385 patent, wherein the position strip is configured to match and screwed with each lateral beam and covered by a lateral beam. Each position strip has an upright wall to contact with each upright post and fixed together with a screw and each lateral beam has an upper wall and two side walls forming a lengthwise opening therebetween. Each of the two sides has a lower engaging arm and an upper engaging arm on an inner wall, with the distance between each upper engaging arm and each lower engaging arm being equal to the height of the upright wall of the position strip, so that each position strip is fixed on an outer surface of each upright post with a screw and in the space between the upper engaging arm and the lower engaging arm, with each lateral beam hiding each screw and each position strip to beautify a fence formed by the lateral and the upright posts.

The '025 patent successfully reduces the cost of the railings or fences by converting one longitudinal rail portion to a position strip configured to be fittingly engagable with the upper engaging arm and the lower engaging arm of the lateral beam. However, the operation of mounting the lateral beams across the upright posts is still a shortcoming thereof. The top rigid metal lateral beam can be slidingly engaged with the top position strip (as shown in FIG. 4A of the '025 patent) longitudinally, but the middle rigid metal lateral beams (as shown in FIG. 4B and FIG. 4C of the '025 patent) require the worker to specifically pull the first wall of lateral beam adjacent the position strip away from the position strip so as to fit the position strip between the upper engaging arm and the lower engaging arm (as shown in FIG. 6A to FIG. 6C of the '025 patent). In order to facilitate the fitting of the position strip between the upper engaging arm and the lower engaging arm, the heights of the upper engaging arm and the lower engaging arm of the first wall adjacent to the position strip must be made shorter than the upper engaging arm and lower engaging arm of the opposing second wall of the rigid lateral beam that are configured to bias against the surface of the upright posts. The shorten upper engaging arm and the lower engaging arm of the lateral beam weaken the engagement of the lateral beam and the position strip that may cause the corresponding lateral beam being dissembled from the position strip when unexpected force is applied to the lateral beam. In addition, upright end post is still required to be fastened to the corresponding ends of the lateral beams by screws that are generally still exposed to outside.

SUMMARY OF THE PRESENT INVENTION

The invention is advantageous in that it provides a hidden interconnection arrangement of fence or railing which not only conceals screws to be exposed out of the lateral beams, but also allows the fence or railing to be assembled at the jobsite or preassembled in the production site in a rapid and effective manner.

Another advantage of the invention is to provide a hidden interconnection arrangement of fence or railing which end posts are also configured to be connected with the lateral beams in a hidden and concealed manner.

Another advantage of the invention is to provide a hidden interconnection arrangement of fence or railing and assembling method thereof, wherein the fence or railing comprises a plurality of lateral beams, a plurality of upright posts, two or more engaging rails, a plurality of resilient lockers and fasteners, and two end posts, which can be packed in array package to reduce its transportation size and cost as well as its manufacturing cost. The user may rapidly assemble the lateral beams, the upright posts and the end posts by means of the engaging rails, the lockers and the fasteners of the hidden interconnection arrangement at the jobsite with a hand tool such as screwdriver.

Another advantage of the invention is to provide a hidden interconnection arrangement of fence or railing and assembling method thereof, wherein the fence or railing comprises a plurality of lateral beams, a plurality of upright posts, two or more engaging rails, a plurality of resilient lockers and fasteners, and two end posts, which can be preassembled in the production site in a fast and effective manner.

Another advantage of the invention is to provide a hidden interconnection arrangement of fence or railing, wherein the interconnection between the lateral beams, upright posts and the end posts are tightly interlocked with each other to form a rigid and strengthen fence or railing.

Another advantage of the invention is to provide a hidden interconnection arrangement of fence or railing, wherein each of the lateral beams is configured as a resilient member that is capable of holding the upright posts in position and engaging tightly with the engaging rail, and each of the end posts is fittingly connected to the corresponding ends of the lateral beams by means of the resilient lockers and stopper shoulders formed at the ends of the lateral beams, so as to ensure a rigid and strengthen configuration of the fence or railing.

Additional advantages and features of the invention will become apparent from the description which follows, and may be realized by means of the instrumentalities and combinations particular point out in the appended claims.

According to the present invention, the foregoing and other objects and advantages are attained by a railing device, comprising:

a plurality of upright posts each having a flat surface, a fastening surface and two or more fastening holes spacedly formed in an upper position and a lower position of the fastening surface;

two or more lateral beams, each having a top wall, a pressing wall and an engaging wall, wherein one of the two or more lateral beams is a top lateral beam and one or more of the lateral beams are interconnecting lateral beams, wherein the top wall of each of the interconnecting lateral beams has a plurality of connection openings formed at spaced intervals, the pressing wall and the engaging wall being extended from two longitudinal sides of the top wall to define a receiving chamber therebetween and a bottom opening having a width slightly smaller than a width of the top wall; and a hidden interconnection arrangement, comprising:

two or more, elongated, engaging rails each having a flat side, a concave side opposing the flat side, and a plurality of position holes formed and extended from the concave side to the flat side at spaced intervals;

a plurality of fasteners configured to pass through the position holes of the engaging rails and fasten to the fastening holes of the upright posts, such that the two or more engaging rails are fastened laterally across the lateral beams so as to fasten the upright posts in parallel upright manner; and a pair of upper engaging arm and lower engaging arm integrally protruded from an inner surface of the engaging wall of each of the lateral beams, defining an engaging recess therebetween, wherein a width of the engaging recess is equal to or slightly wider than a width of each of the engaging rails, wherein a height of the upper and lower engaging arms is equal to or larger than a thickness of each of the engaging rails, wherein a curved bottom guider edge is formed along the lower engaging arm, such that a downward force applied to the top wall of one of the lateral beams is able to press the bottom guider edge of the lower engaging arm downwards against a top edge of one of the engaging rails that generates a reaction force to enlarge the bottom opening of the lateral beam to allow the engaging rail to be engaged in the engaging recess and locked between the upper engaging arm and the lower engaging arm of the lateral beam while the fasteners that fastened the engaging rails to the upright posts are hidden and concealed by the lateral beams and the pressing walls of the lateral beams press against the flat surfaces of the upright posts respectively.

In one embodiment, the railing device further comprises at least one tubular end post assembled to form a fence, wherein the end post has two or more end holes spacedly formed in an inner wall of the end post, each having a size and shape corresponding to a cross sectional size and shape of each of the lateral beams, such that end portions of the two or more lateral beams are able to fittingly insert through the end holes respectively. In addition, the hidden interconnection arrangement further comprises two or more resilient lockers and each of the end portions of the lateral beams has a pair of locker holes formed in two opposing sides thereof, wherein each of the resilient lockers comprises a V shape resilient member and two locker stubs outwardly extended from two ends of the resilient member respectively. Each of the resilient lockers is adapted to be inserted into the corresponding end portion of the lateral beam, such that the end portion transversely inserted into the end post through the end hole until the pair of the locker holes being passed through the end hole and positioned in the end post is able to be locked in position by extending the two locker stubs out through the pair of locker holes of the corresponding lateral beam so as to lock the end portion of the lateral beam with the end post.

In one embodiment, the end portion of each of the lateral beams is inserted into the end post through the corresponding end hole until an end of the end portion of the lateral beam in contact with an inner surface of an outer wall of the end post.

In one embodiment, an indented corner recess is formed at an end of the end portion of each of the lateral beams to define a stopper edge adapted to be pressed against a wall surface adjacent the end hole of the end post after the end portion is inserted into the end post through the end hole while the pair of locker holes of the lateral beams being passed through the end hole and positioned in the end post.

In accordance with another aspect of the invention, the foregoing and other objects and advantages are attained by an assembling method of a fence or a railing, comprising steps of:

(a) aligning a plurality of upright posts spacedly in parallel manner;

(b) mounting two or more lateral beams crossingly with the upright posts by inserting the upright posts through a plurality of connection openings formed at spaced intervals in a top wall of each of the lateral beams respectively, wherein each of the lateral beams has a pressing wall and an engaging wall extended from two longitudinal sides of the top wall to define a bottom opening having a width slightly smaller than a width of the top wall of the lateral beams while the pressing wall forms a resilient arm adapted for pressing against the upright posts;

(c) fastening two or more engaging rails across the plurality of the upright posts laterally by inserting a plurality of fasteners through a plurality of position holes formed therein at spaced intervals and fastening the fasteners to fastening holes spacedly formed in an upper position and a lower position of a fastening surface of each of the plurality of the upright posts respectively; and (d) engaging the two or more engaging rails in engaging recesses formed in inner surfaces of the engaging walls of the two or more lateral beams respectively by pressing the two or more lateral beams downwardly toward bottom ends of the upright posts until the plurality of the upright posts are interconnected with the two or more engaging rails so as to mount the two or more lateral beams across the plurality of the upright posts laterally.

In one embodiment, in the step (d), the downward pressing of the lateral beam against the corresponding engaging rail enlarges an bottom opening defined between two ends of the pressing wall and the engaging wall to allow the corresponding engaging rail to be positioned in the engaging recess of the lateral beam.

In one embodiment, the step (c) further comprises a step of fastening a top engaging rail across upper ends of the plurality of the upright posts laterally by inserting a plurality of fasteners through a plurality of position holes formed in the top engaging rail at spaced intervals and screwing the fasteners to fastening holes spacedly formed in at top positions of the fastening surfaces of the plurality of the upright posts respectively, and that the step (d) further comprises a step of engaging the top engaging rail in an engaging recess formed in an inner surface of an engaging wall of a top lateral beam by sliding the top lateral beam across the top engaging rail while the engaging rail is engaged in an engaging recess formed in an inner surface of an engaging wall of the top lateral beam so as to mount the top lateral beam across the top ends of the plurality of the upright posts laterally.

In one embodiment, the assembling method further comprise steps of:

(e) installing a V-shape resilient locker in each end portion of each of the two or more lateral beams;

(f) fittingly inserting the end portions of the two or more lateral beams through end holes spacedly formed on an inner wall of the end post until a pair of locker holes formed in two opposing sides of each of the two or more lateral beams being passed through the end hole and positioned in the end post; and (g) locking two locker stubs protruded from two ends of the resilient member of the locker with the pair of locker holes by extending the two locker stubs through the two locker holes of the corresponding lateral beam so as to lock the end portions of the lateral beams with the end post.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
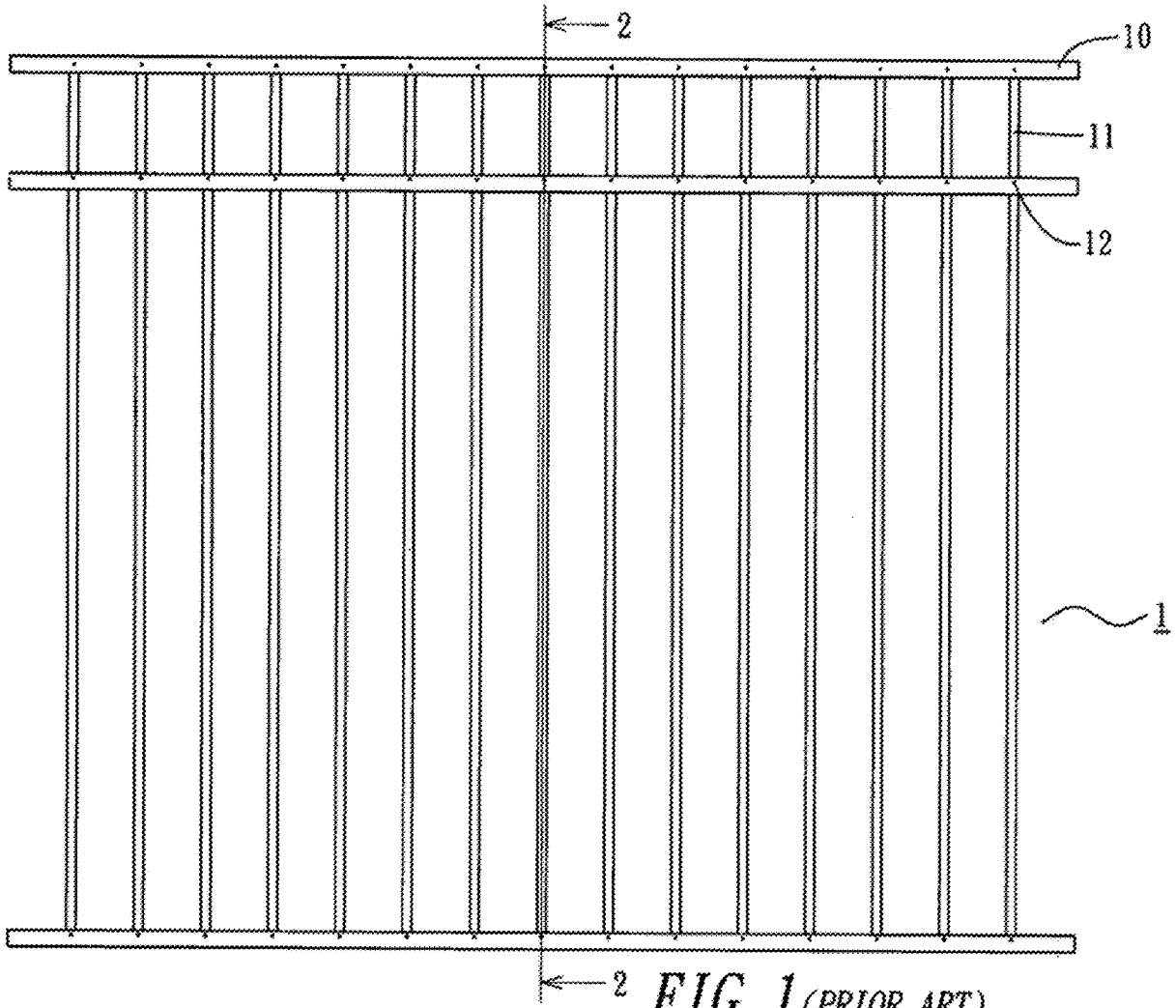
FIG. 1 (PRIOR ART)
FIG. 1 is a front view of a conventional metal fence.
Figure 2:
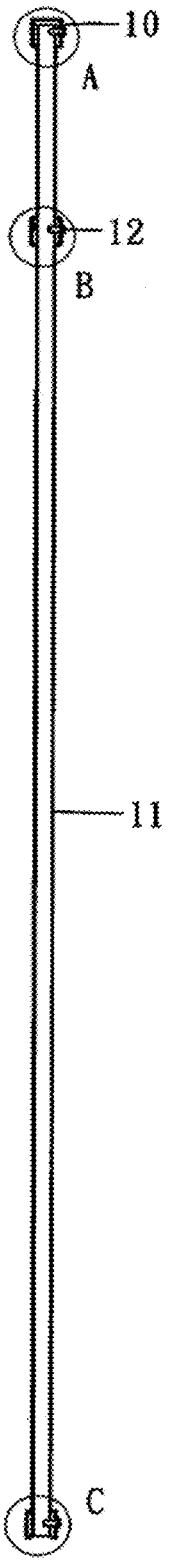
FIG. 2 (PRIOR ART)
FIG. 2 is a cross-sectional view of line 2-2 in FIG. 1.
Figure 2A:
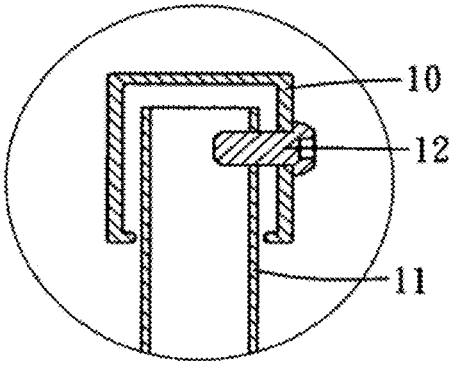
FIG. 2A (PRIOR ART)
FIG. 2A is a partial enlarged view of the part marked (A) in FIG. 2.
Figure 2B:
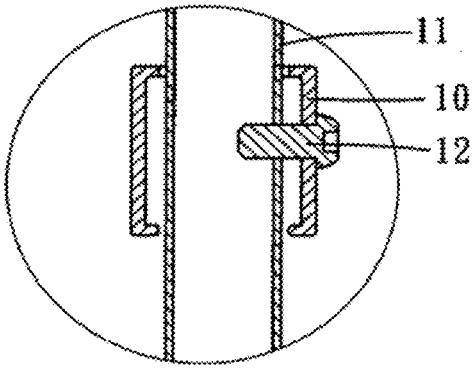
FIG. 2B (PRIOR ART)
FIG. 2B is a partial enlarged view of the part marked (B) in FIG. 2.
Figure 2C:
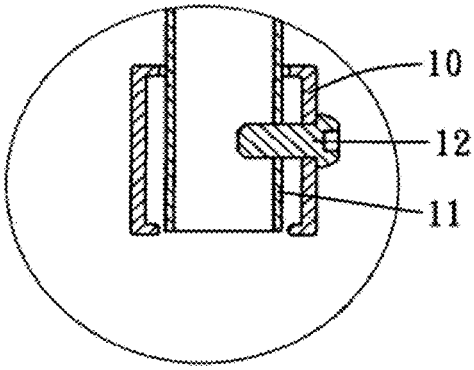
FIG. 2C (PRIOR ART)
FIG. 2C is a partial enlarged view of the part marked (D) in FIG. 2.

The present invention discloses a hidden interconnection arrangement 30 of fence or railing and assembling method thereof. Referring to FIG. 3 to FIG. 14, a fence 1 comprises at least an end post 10 and a railing device 20, wherein the railing device 20 comprises a plurality of upright posts 21 and two or more lateral beams 22 interconnected the plurality of the upright posts 21 at spaced interval by means of a hidden interconnection arrangement 30 (as shown in FIG. 5). The number of the upright posts 21 determines a length of the fence 1, wherein the pair of sectional broken lines as shown in FIG. 1 demonstrates a predetermined length of the lateral beams 22 and numbers of the upright posts 21 for illustration purpose in the drawing.

Referring to FIG. 5 to FIG. 8, each of the plurality of the upright posts 21 is an elongated tubular member made of rigid material such as metal, which has a flat surface 211, a fastening surface 212 and two or more fastening holes 213 spacedly formed in at least an upper position and a lower position of the fastening surface 212.

Figure 4:
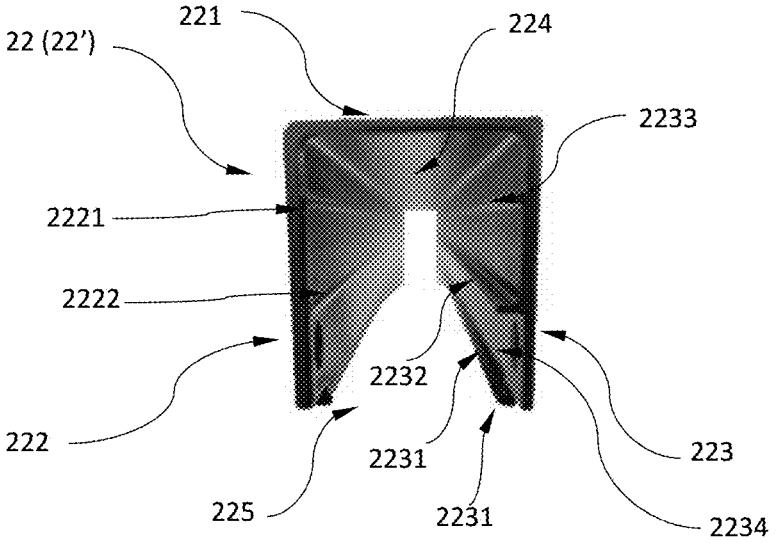
FIG. 4 is an end perspective view of a lateral beam of the fence with hidden interconnection arrangement according to the above preferred embodiment of the present invention.
Figure 5:
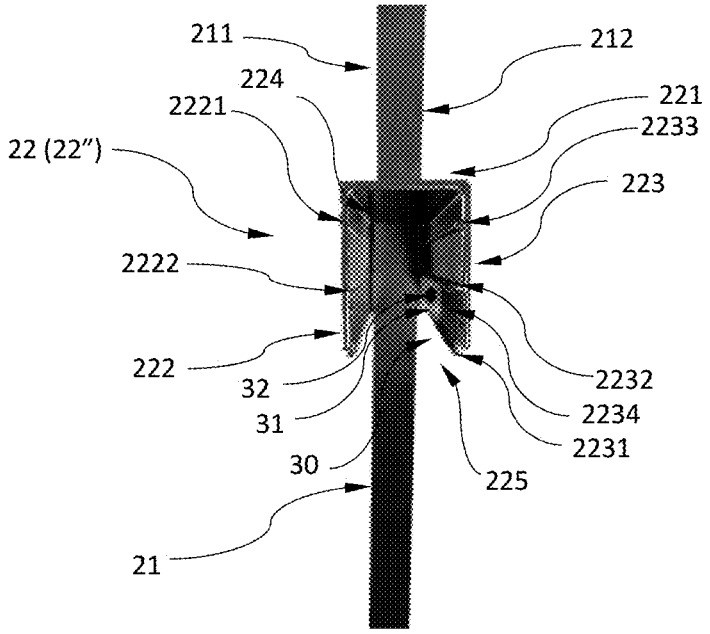
FIG. 5 is an end view of a lateral beam and an upright post of the fence with hidden interconnection arrangement according to the above preferred embodiment of the present invention.

Referring to FIG. 4 and FIG. 5, each of the two or more lateral beams 22 has a top wall 221, a pressing wall 222 and an engaging wall 223, wherein the pressing wall 222 and the engaging wall 223, defining a receiving chamber 224 between the pressing wall 222 and the engaging wall 223 and a bottom opening 225. The engaging wall 223, which is perpendicularly extended from one longitudinal side of the top wall 221, has a lower engaging arm 2231 and an upper engaging arm 2232 and an reinforcing rib 2233, wherein the two engaging arms 2231, 2232 are integrally and parallelly protruded from a lower portion of the engaging wall 223 inwardly in the receiving chamber 224 to define an engagement recess 2234 between the two engaging arms 2231, 2232, and the reinforcing rib 2233 is integrally protruded from an upper portion of the engaging wall 223 to provide a reinforcing support to engaging wall 223. The pressing wall 222 is a resilient wall slantly extended from another longitudinal side of the top wall 221 such that a width of the bottom opening 225 is slightly narrower than a width of the top wall 221 to provide an elastic effect, wherein a pair of contact bulges 2221, 2222 formed on an inner surface of the pressing wall 222 configured for reducing a contact area of the pressing wall 222 and the upright posts 21 and applying a pressing force against the upright posts 21 positioned in the receiving chamber 224. It is worth mentioning that a height of each of the contact bulges 2221, 2222 is preferred to be much smaller than a thickness of the pressing wall 222 for simply reducing the contact area of the pressing wall 222 and a height of each of the engaging arms 2231, 2232 is preferred to be larger than a thickness of the engaging wall 223 for providing an engagement ability.

Figure 6A:
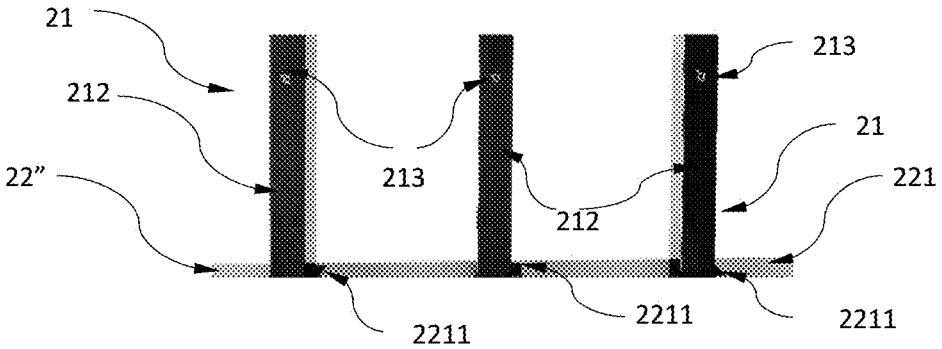
FIG. 6A is a front view illustrating the upright posts of the fence with hidden interconnection arrangement at spaced intervals according to the above preferred embodiment of the present invention.
Figure 6B:
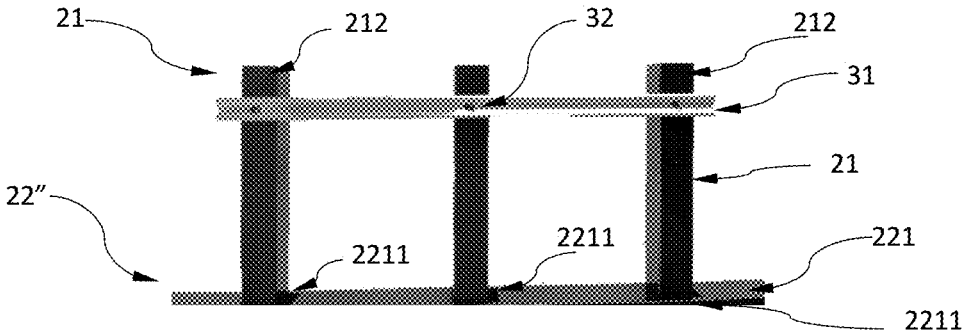
FIG. 6B is a front view illustrating the upright posts interconnected by an engaging rail of the fence with hidden interconnection arrangement according to the above preferred embodiment of the present invention.

One of the each of the two or more lateral beams 22 is a top lateral beam 22', as shown in FIG. 4, and one or more of the lateral beams 22 are further configured as interconnecting lateral beams 22" each of which top wall 221 has a plurality of connection openings 2211 formed at spaced intervals, as shown in FIG. 5 to FIG. 6B. The size and shape each of the connection openings 2211 are configured to allow one corresponding upright post 21 to penetrate through, wherein each of the connection openings 2211 has a size equal to or larger than a cross sectional size of each of the upright posts 21.

Figure 3:
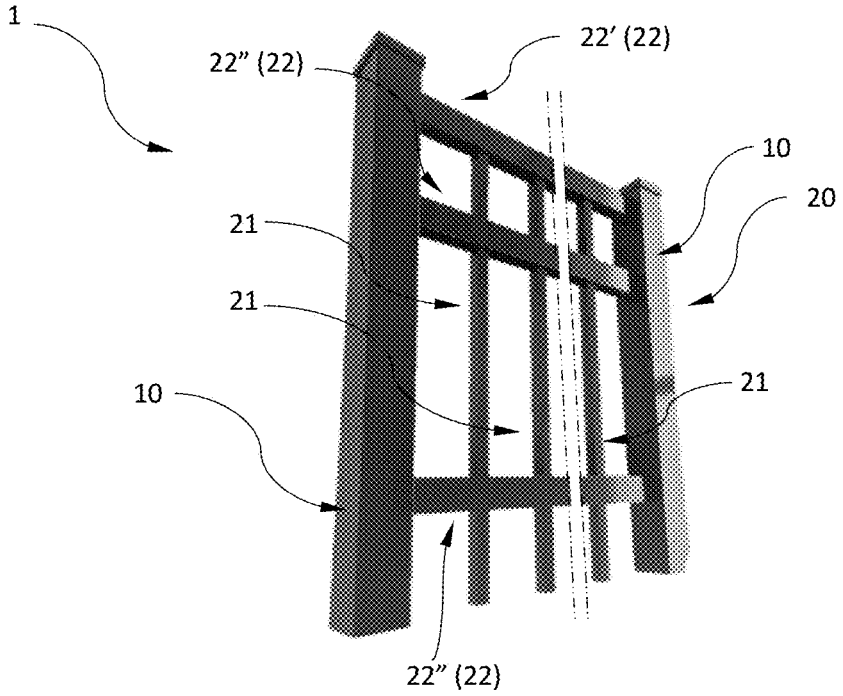
FIG. 3 is a perspective view of a fence with hidden interconnection arrangement according to a preferred embodiment of the present invention.

According to the preferred embodiment, as shown in FIG. 3, three lateral beams 22, including two interconnecting lateral beams 22" interconnecting crossingly with upper portions and lower portions of the plurality of the upright posts 21 and one top beam 22' being mounted on top ends of the plurality of the upright posts 21.

Figure 8:
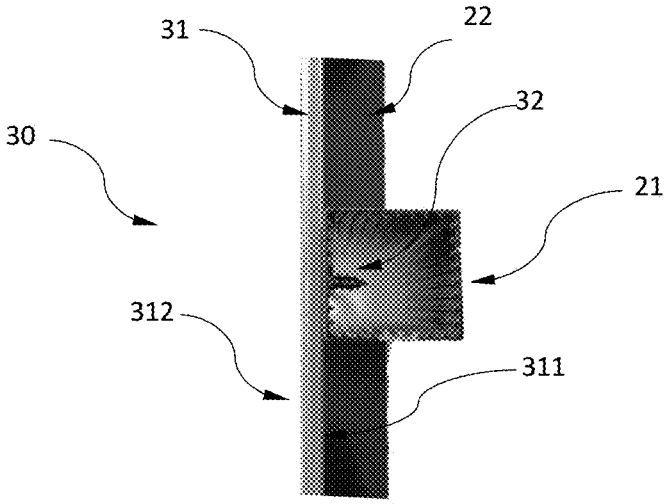
FIG. 8 is a top view illustrating the interconnection of the upright post, the lateral beam and the engaging rail of the fence with hidden interconnection arrangement according to the above preferred embodiment of the present invention.

Referring to FIG. 5, to FIG. 8, the hidden interconnection arrangement 30 comprises the engaging arms 2231, 2232 protruded on the inner surface of the engaging wall 223 of each of the lateral beams 22 as described above and two or more, elongated, engaging rails 31, made of rigid metal, each having a flat side 311, a concave side opposing the flat side 312, and a plurality of position holes 313 formed and extended from the concave side 312 to the flat side 311 at spaced intervals. According to the preferred embodiment, three lateral beams 22 are embodiment and, correspondingly, three engaging rails 31 are configured while each of the upright posts has three fastening holes 213 formed at a top position, an upper position and a lower position respectively, such that the three engaging rails 31 can be fastened across the upright posts 21 in a parallel manner so as to configured a rigid railing device. In order words, the rigid engaging rails 31 substantially support the upright posts 21 in upright position at spaced intervals.

The hidden interconnection arrangement 30 further comprises a plurality of fasteners 32 configured to pass through the position holes 313 of the engaging rails 31 and fasten to the fastening holes 213 of the upright posts 21, such that the two or more engaging rails 31 are fastened laterally across the lateral beams 22 so as to fasten the upright posts 21 in parallel upright manner. According to the preferred embodiment, the fasteners 32 are embodied as screws and the fastening holes 213 of the upright posts 21 are embodied as screw holes correspondingly. In addition, the position holes 313 of the engaging rail 31 can be through holes or screw holes corresponding to the screwing fasteners 32.

The lower engaging arm 2231 and upper engaging arm 2232 are integrally protruded from the inner surface of the engaging wall 223 of each of the lateral beams 22 and preferred to each having a height larger than a thickness of the engaging rail 31, wherein a width of the engaging recess 2234 is equal to or slightly wider than a width of each of the engaging rails 31, such that the engaging recess 2234 defined between the lower and upper engaging arms 2231, 2232 is able to be fittingly received the engaging rail 31 therein and locked in position.

Figure 7:
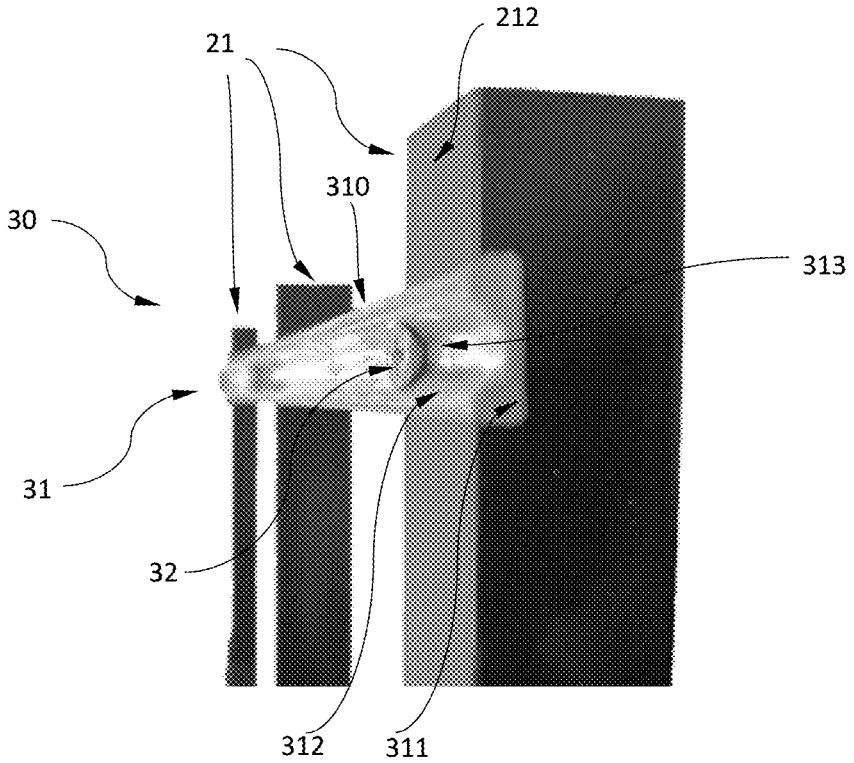
FIG. 7 is a perspective view illustrating the upright posts interconnected by the engaging rail of the fence with hidden interconnection arrangement according to the above preferred embodiment of the present invention.

According to the preferred embodiment, as shown in FIG. 4, a curved bottom guider edge 22311 is formed along the lower engaging arm 2231, such that a downward force applied to the top wall of one of the lateral beams 22 is able to press the bottom guider edge 2311 of the lower engaging arm 2231 downwards against a top edge 310 of one of the engaging rails 31, as shown in FIG. 7, that generates a reaction force to enlarge the bottom opening 225 of the lateral beam 22 to allow the engaging rail 31 to be engaged in the engaging recess 2234 and locked between the upper engaging arm 2232 and the lower engaging arm 2231 of the lateral beam 22 while the fasteners 32 that fastened the engaging rail 31 to the upright posts 21 are hidden and concealed by the lateral beam 22 and the pressing wall 222 of the lateral beam 21 presses against the flat surfaces 211 of the upright posts 21, as shown in FIG. 5.

In other words, the lateral beams 22 are utilized to hide and cover the engaging rails 31 which are the elements for supporting and fastening the upright posts 21 in upright and parallel position to form a railing system. Therefore, the lateral beams 22 can be made thinner that not only reduces the cost of material but also provides a resilient ability rendering the slightly slanting inwards pressing wall 222 to form a resilient element adapted to press against the upright posts 21, such that the lateral beams 22 may also strengthen and support the engaging rails 31 respectively.

Figure 9:
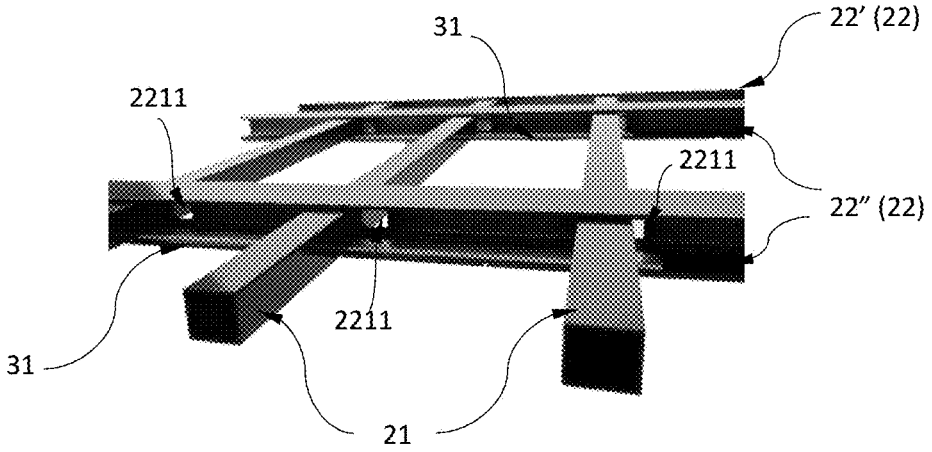
FIG. 9 is a bottom perspective view of the fence with hidden interconnection arrangement according to the above preferred embodiment of the present invention.
Figure 10:
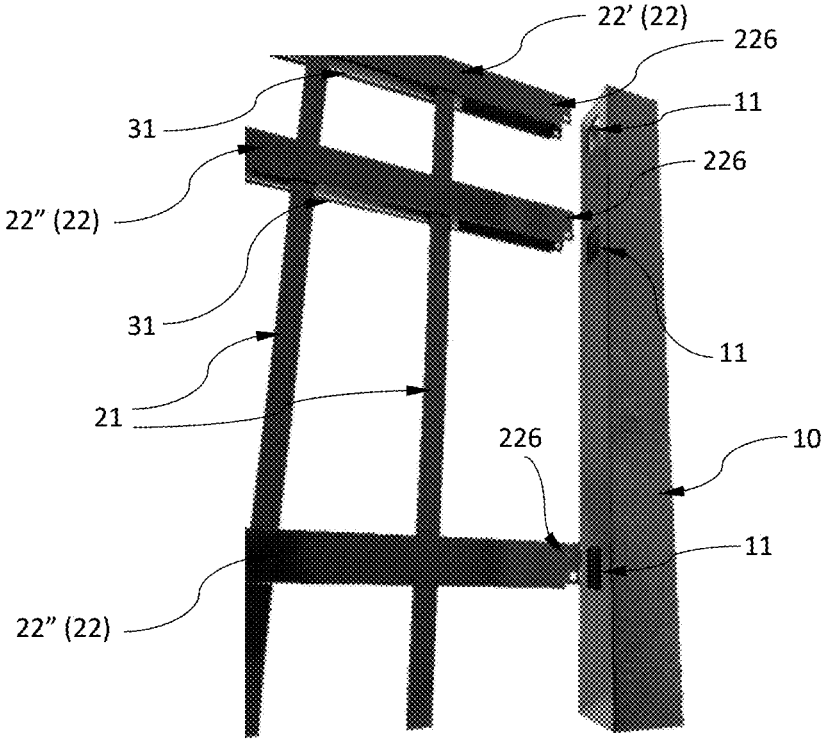
FIG. 10 is a partial exploded perspective of the fence with hidden interconnection arrangement according to the above preferred embodiment of the present invention.

Since the upright posts 21, the lateral beams 22 and the engaging rails 31 of the railing device 20 can be packed before assembly so as to minimize the packaging size that substantially reduces the transportation size and cost. At the jobsite, the user may assemble the railing device 20 by the following steps:

(a) aligning the plurality of the upright posts 21 spacedly in parallel manner;

(b) mounting the interconnecting lateral beams 22" crossingly with the upright posts 21 by inserting the upright posts 21 through the plurality of the connection openings 2211 formed at spaced intervals in the top wall 221 of each of the interconnecting lateral beams 22" respectively, wherein each of the interconnecting lateral beams 22" has the pressing wall 222 and the engaging wall 223 extended from two longitudinal sides of the top wall 221 to define the bottom opening 225 therebetween while the pressing wall 222 forms a resilient arm to press against the upright posts 21;

(c) fastening the engaging rails 31 across the plurality of the upright posts 21 laterally by inserting the plurality of the fasteners 32 through the plurality of the position holes 313 formed in the engaging rails 31 at spaced intervals and screwing the fasteners 32 to the fastening holes 213 spacedly formed in the upper position and the lower position of the fastening surface 212 of each of the plurality of the upright posts 21 respectively, wherein the flat sides 311 of the engaging rails 31 are flatly placed on the engaging surfaces 212 of the upright posts 21; and (d) engaging the engaging rails 31 fastened to the upper positions and the lower positions of the upright posts 21 in the engaging recesses 2234 formed in the inner surfaces of the engaging walls 223 of the two interconnecting lateral beams 22" respectively by pressing the interconnecting lateral beams 22" downwardly toward bottom ends of the upright posts 21 until the upright posts 21 are interconnected with the engaging rails 31 so as to mount the interconnecting lateral beams 22" across the upright posts 21 laterally, as shown in FIG. 9.

It is appreciated that, through the step (b), the upright posts 21 are spacedly arranged in position by means of the interconnecting lateral beams 22" that significantly facilitates the subsequent step (c) of fastening the engaging rails 31 to the upright posts 21 since the position holes 313 of the engaging rails 31 are easily to be aligned with the fastening holes 213 of the upright posts 21 respectively while the upright posts 21 are spacedly mounted by the interconnecting lateral beams 22".

When the railing device 20 includes a top lateral beam 22', the step (c) of the assembling method further comprises a step (c1) of fastening a top engaging rail 31 across top positions of the plurality of the upright posts 21 laterally by inserting the fasteners 32 through the position holes formed in the top engaging rail 31 at spaced intervals and fastening the fasteners 32 to the fastening holes 213 spacedly formed in a top position of the fastening surface 212 of each of the plurality of the upright posts 21 respectively, and the step (d) further comprises a step (dl) of engaging the top engaging rail 31 in the engaging recess 225 formed in an inner surface of the engaging wall 223 of the top lateral beam 22' respectively by sliding the top lateral beam 22' across the top engaging rail 31 while the top engaging rail 31 is engaged in an engaging recess 2234 formed in the inner surface of the engaging wall 223 of the top lateral beam 22' so as to mount the top lateral beam 22' across the top ends of the plurality of the upright posts 21 laterally.

According to the preferred embodiment, in the step (d), the downward pressing of the lateral beam 22 (either the top lateral beam 22' or the interconnecting lateral beam 22") against the corresponding engaging rail 31 enlarges the bottom opening 225 defined between two ends of the pressing wall 222 and engaging wall 223 to allow the corresponding engaging rail 31 to be positioned in the engaging recess 2234 of the lateral beam 22.

Figure 15A:
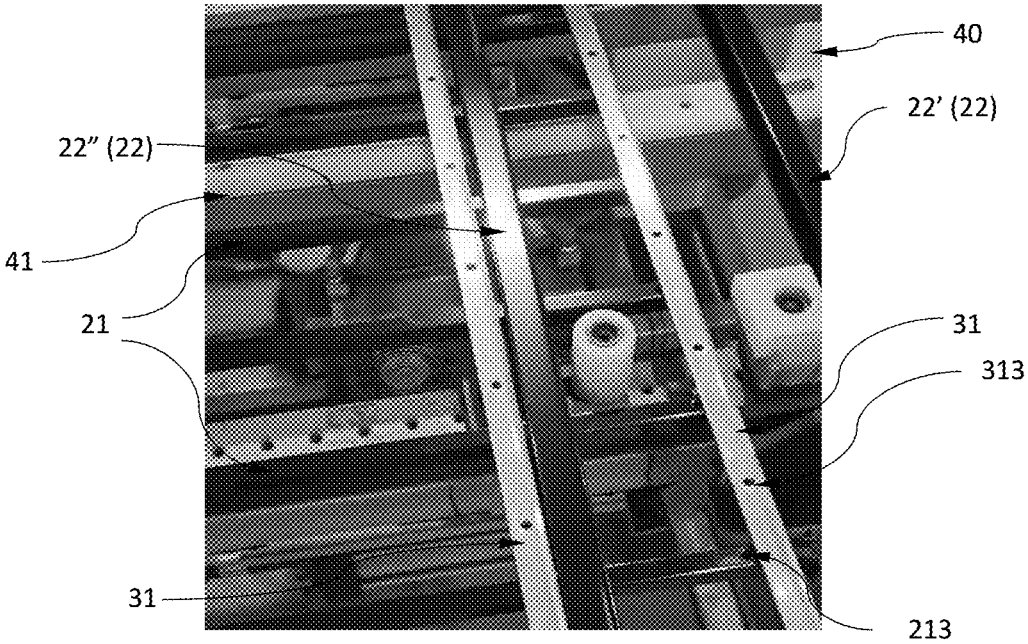
FIG. 15A to FIG. 15F are schematic views illustrating an assembling method of a hidden interconnection arrangement of fence or railing according to the above preferred embodiment of the present invention.
Figure 15B:
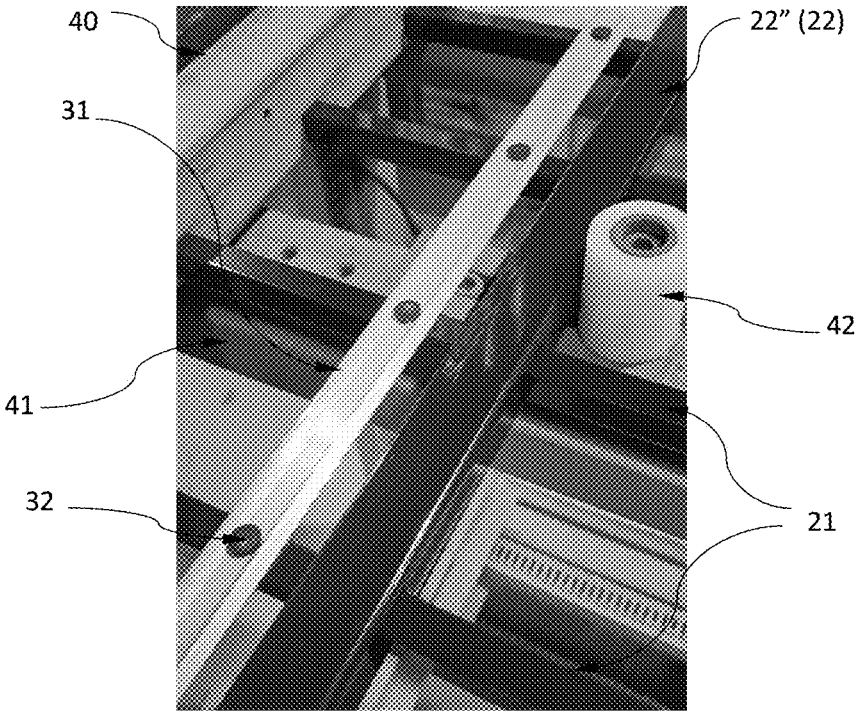
Figure 15C:
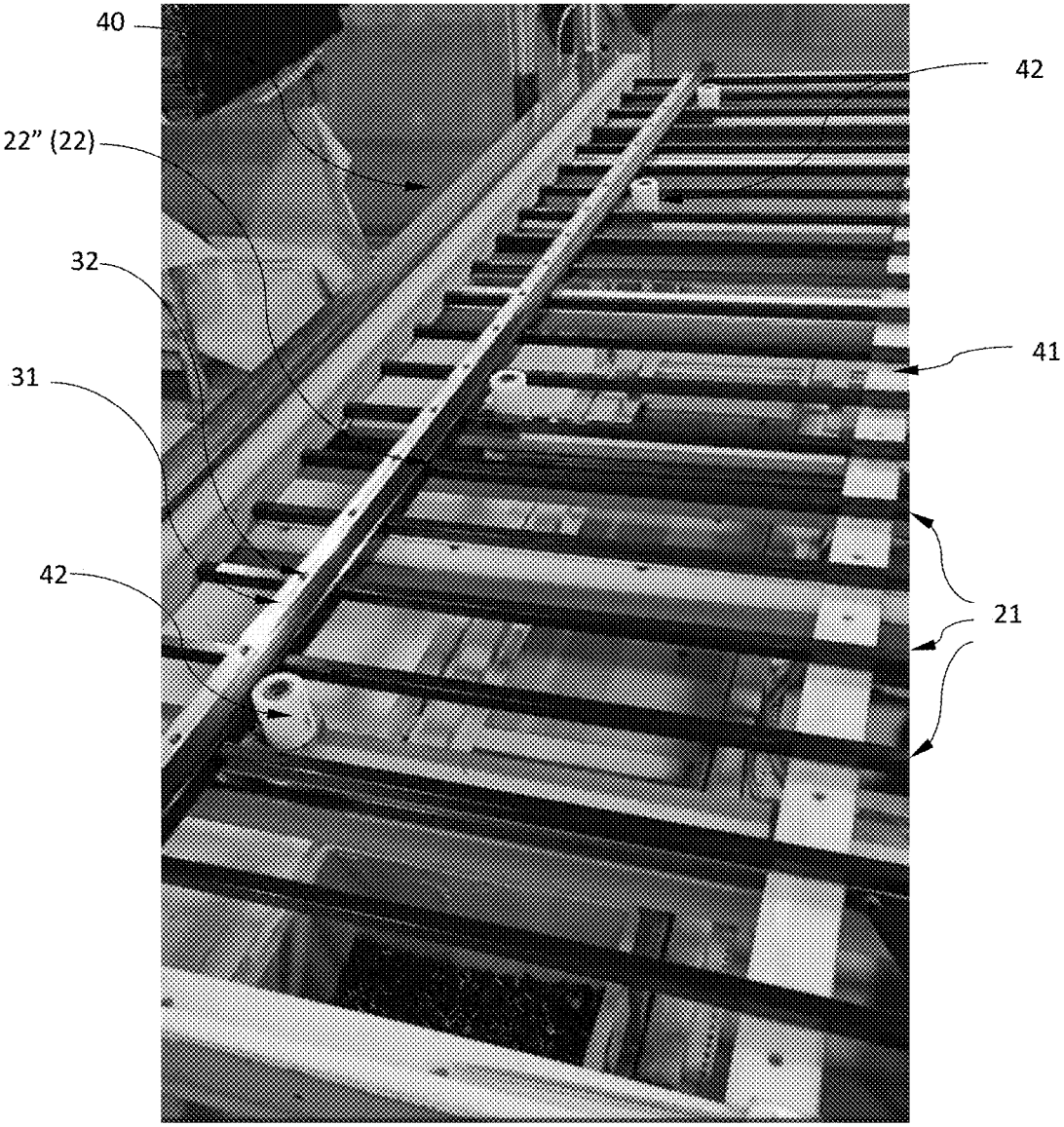

It is appreciated that the railing device 20 is configured to be able to assemble at the jobsite by the user through the step (a) to the step (d) and to preassemble by the manufacturers in a semi-automatic way by means of an assembling apparatus 40, as shown in FIG. 15A to FIG. 15F. Referring to FIG. 15A, the step (a) can be executed on a working platform 41 of the assembly apparatus 40 to align the plurality of the upright posts 21 spacedly in parallel manner, that facilitates the step (b) of mounting the interconnecting lateral beams 22" crossingly with the upright posts 21. Referring to FIG. 15B, the step (c) of screwing the fasteners 32 to fasten the engaging rails 31 to the upright posts 21 can be executed by screwdriver manually or by power tool.

Figure 15D:
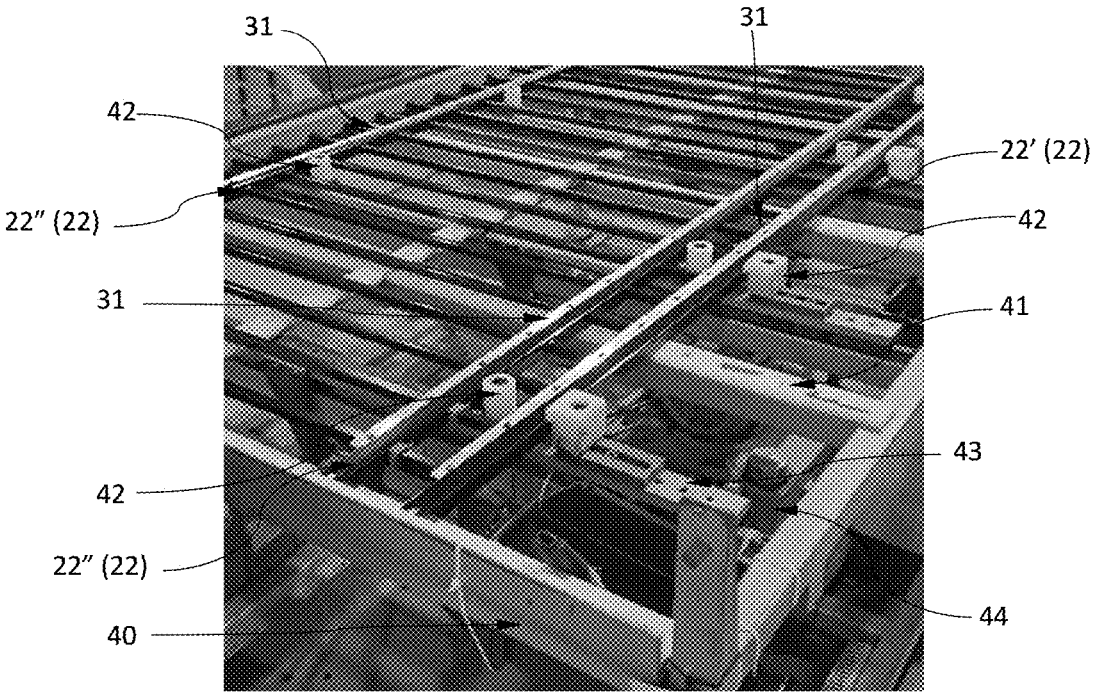
Figure 15E:
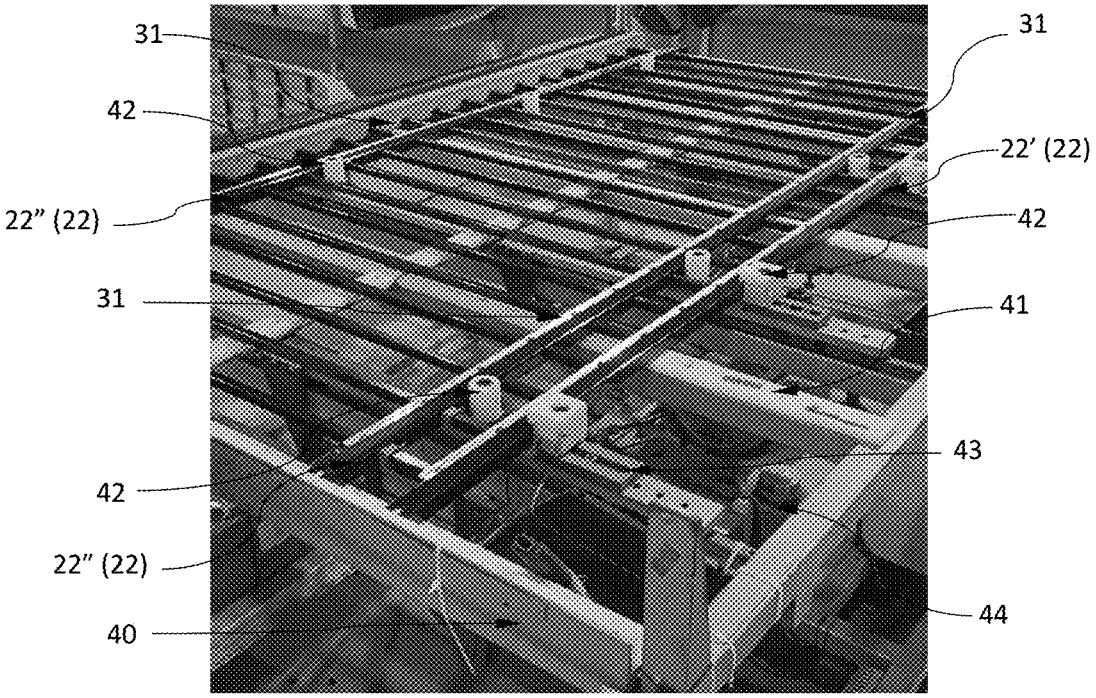
Figure 15F:
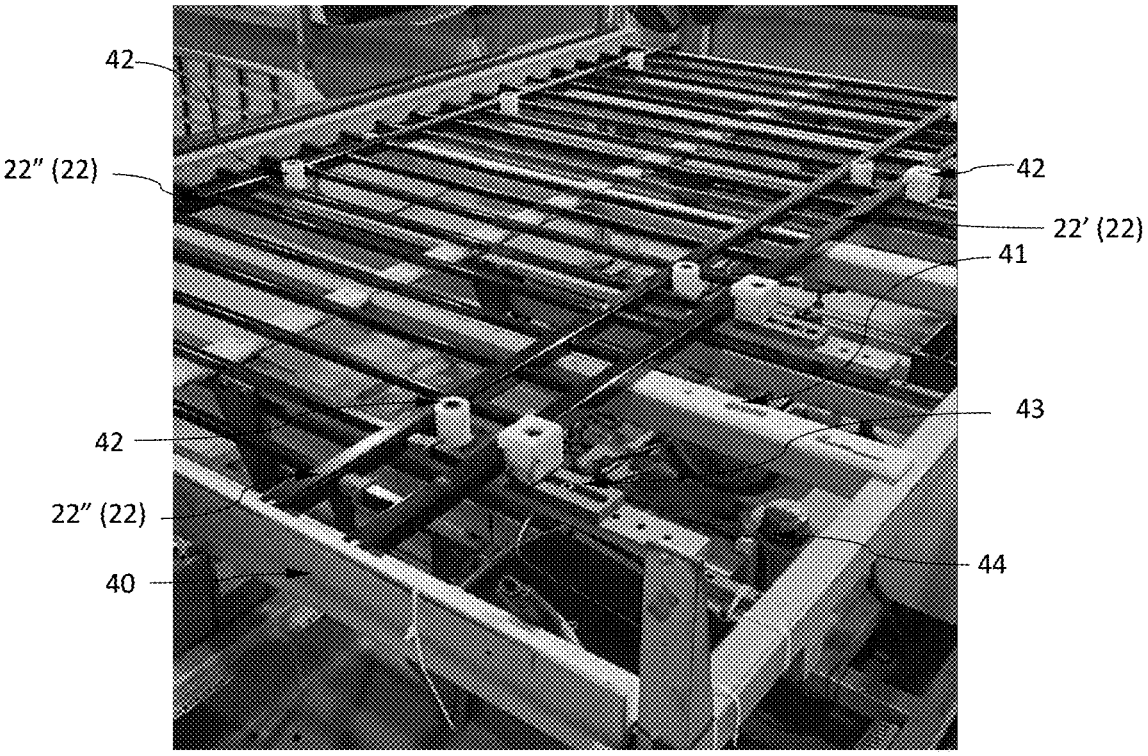

After the step (c), referring to FIG. 15C to FIG. 15F, the step (d) can be executed by pushers 42 which are positioned adjacent to the lateral beams 22 and driven by a driving mechanism 43 powered by a hydraulic or electrical system 44. As shown in FIG. 15D, the step (d) is automatically executed by the hydraulic or electrical system 44 which actuates the driving mechanism 43 to move and push the pushers 42 to press against the lateral beams 22 towards the bottom ends of the upright posts 21 until the curved bottom guider edges 22311 formed along the lower engaging arms 2231 of the lateral beams 22 (as shown in FIG. 4) being guided by the engaging rails 31 to force the bottom openings 225 of the lateral beams 22 to be enlarged. As shown in FIG. 15E, the driving mechanism 43 continues to push the pushers 42 to press the lateral beams 22 towards the bottom ends of the upright posts 21 against the engaging rails 31 to push the engaging rails 31 to be engaged into the corresponding engaging recesses 2234 of the top lateral beam 22' and the interconnecting lateral beams 22" respectively until all the engaging rails 31 are completely engaged in the corresponding engaging recesses 2234 of the lateral beams 22 respectively, as shown in FIG. 15F.

Figure 11:
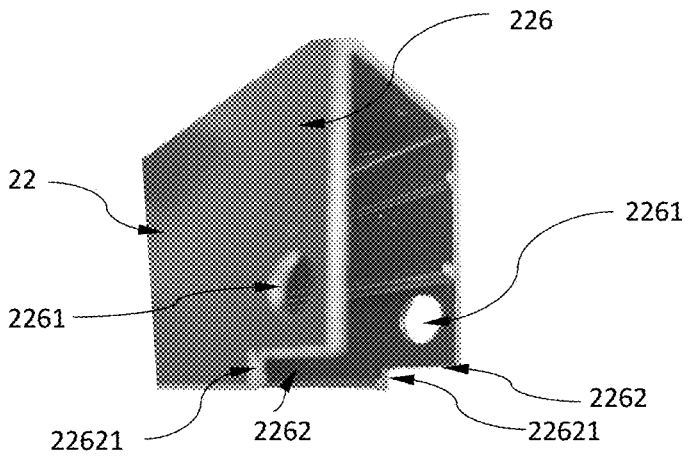
FIG. 11 is a partial perspective view of an end portion of the lateral beam of the fence with hidden interconnection arrangement according to the above preferred embodiment of the present invention.
Figure 14:
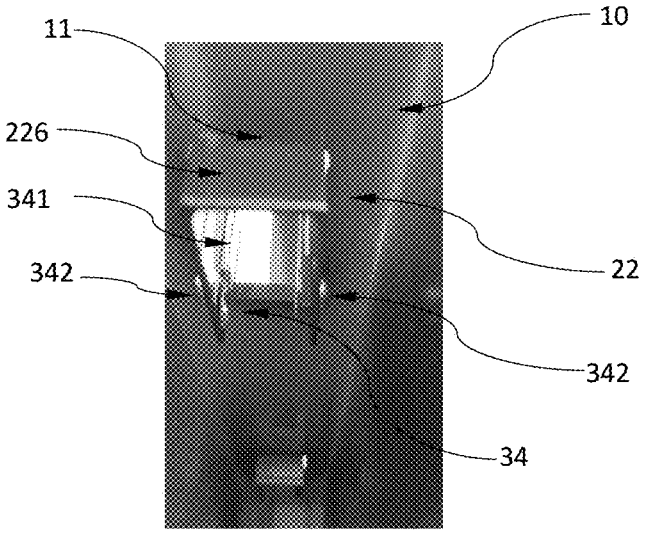
FIG. 14 is a partial perspective view illustrating the end portion of the lateral beam interlocked with the end post with the locker of the fence with hidden interconnection arrangement according to the above preferred embodiment of the present invention.

According to the preferred embodiment, referring to FIG. 3 and FIGS. 10-14, the railing device 20 is configured to be assembled with a pair of end posts 10 to form the fence 1, wherein the end post 10 is embodied as a tubular post having two or more end holes 11 spacedly formed in an inner wall 101 of the end post 10, each having a size and shape corresponding to a cross sectional size and shape of each of the lateral beams 22. The hidden interconnection arrangement 30 further includes two end portions 226 of each of the lateral beams which are able to fittingly insert through the end holes 11 of the pair of the end posts 10 respectively. In addition, the hidden interconnection arrangement 30 further comprises two or more resilient lockers 34 and each of the end portions 226 of the lateral beams 22 has a pair of locker holes 2261 formed in two opposing sides thereof (as shown in FIG. 11). As shown in FIG. 11, each of the resilient lockers 34 comprises a V shape resilient member 341 and two locker stubs 342 outwardly extended from two ends of the resilient member 341 respectively. Each of the resilient lockers 34 is adapted to be inserted into the corresponding end portion 226 of the lateral beam 22, such that the end portion 226 transversely inserted into the end post 10 through the end hole 11 until the pair of the locker holes 2261 being passed through the end hole 11 and positioned in the end post 10 is able to be locked in position by extending the two locker stubs 342 out through the pair of locker holes 2261 of the corresponding lateral beam 22, as shown in FIG. 14, so as to lock the end portion 226 of the lateral beam 22 with the end post 10.

Alternatively, the end portion 226 of each of the lateral beams 22 can be inserted into the end post 10 through the corresponding end hole 11 until an end of the end portion 226 of the lateral beam 22 in contact with an inner surface of an outer wall of the end post 10.

Figure 12:
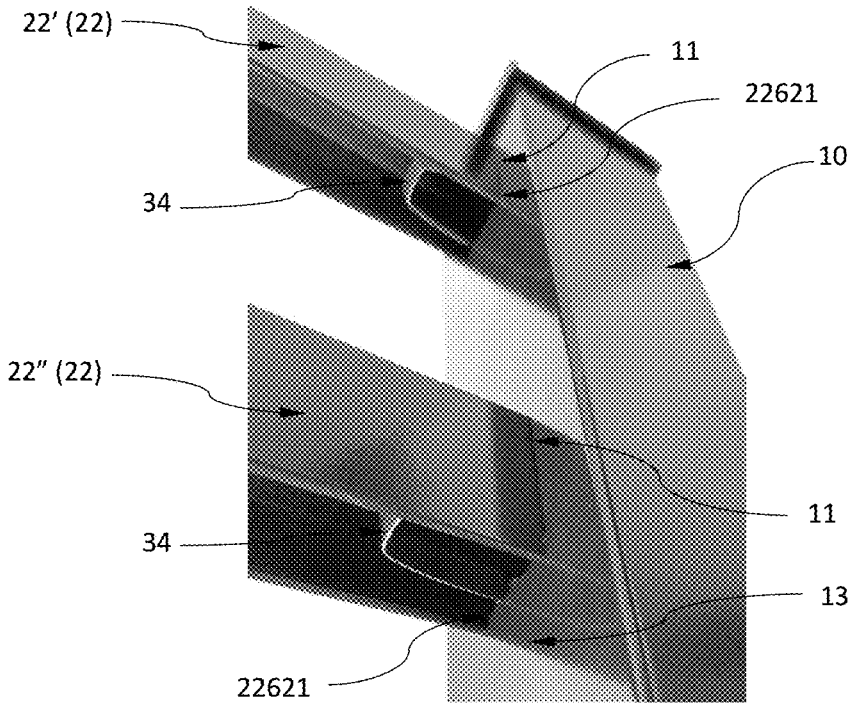
FIG. 12 is a partial perspective view illustrating the interconnection of the lateral beams and the end post of the fence with hidden interconnection arrangement according to the above preferred embodiment of the present invention.
Figure 13:
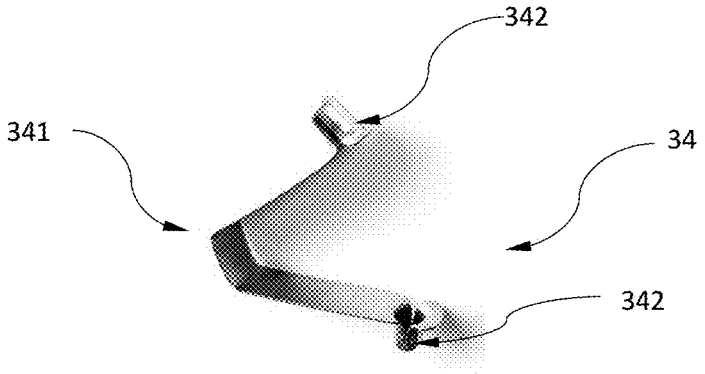
FIG. 13 is a perspective view of a locker of the fence with hidden interconnection arrangement according to the above preferred embodiment of the present invention.

According to the preferred embodiment, referring to FIG. 11, an indented corner recess 2262 is formed at an end of the end portion 226 of each of the lateral beams 22 to define a stopper edge 22621 adapted to be pressed against a wall surface 13 adjacent the end hole 11 of the end post 10, as shown in FIG. 12, after the end portion 226 is inserted into the end post 10 through the end hole 11, as shown in FIG. 14, while the pair of locker holes 2261 of the lateral beams 22 being passed through the end hole 11 and positioned in the end post 10.

Accordingly, to assemble the railing device 20 to form a fence, the assembling method further comprises steps of:

(e) installing the V-shape resilient locker 34 in each the end portion 226 of each of the lateral beams 22;

(f) fittingly inserting the end portions 226 of the lateral beams 22 through the end holes 11 spacedly formed on the inner wall 13 of the end post 10 until the pair of locker holes 2261 formed in two opposing sides of the end portion 226 of each of the lateral beams 22 being passed through the end hole 11 and positioned in the end post 10; and (g) locking the two locker stubs 342 protruded from two ends of the resilient member 341 of the locker 34 with the pair of locker holes by extending the two locker stubs through the two locker holes 2261 of the corresponding lateral beam 22 so as to lock the end portions 226 of the lateral beams 22 with the end post 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A railing device, comprising:

a plurality of upright posts each having a flat surface, a fastening surface and two or more fastening holes spacedly formed in an upper position and a lower position of said fastening surface;

two or more lateral beams, each having a top wall, a pressing wall and an engaging wall, wherein said top wall of each of said lateral beams has a plurality of connection openings formed at spaced intervals, said pressing wall and said engaging wall being extended from two longitudinal sides of said top wall to define a receiving chamber therebetween and a bottom opening having a width slightly smaller than a width of said top wall; and a hidden interconnection arrangement, comprising:

two or more, elongated, engaging rails each having a flat side, a concave side opposing said flat side, and a plurality of position holes formed and extended from said concave side to said flat side at spaced intervals;

a plurality of fasteners configured to pass through said position holes of said engaging rails and fasten to said fastening holes of said upright posts, such that said two or more engaging rails are fastened laterally across said lateral beams so as to fasten said plurality of said upright posts in parallel upright manner; and a pair of upper engaging arm and lower engaging arm integrally protruded from an inner surface of said engaging wall of each of said lateral beams, defining an engaging recess between said upper engaging arm and said lower engaging arm, wherein a width of said engaging recess is equal to or slightly wider than a width of each of said engaging rails, wherein a height of each of said upper engaging arm and said lower engaging arm is equal to or larger than a thickness of each of said engaging rails, wherein a curved bottom guider edge is formed along said lower engaging arm, such that a downward force applied to said top wall of one of said two or more lateral beams is able to press said bottom guider edge of said lower engaging arm downwards against a top edge of one of two or more engaging rails that generates a reaction force to enlarge said bottom opening of said lateral beam to allow said engaging rail to be engaged in said engaging recess and locked between said upper engaging arm and said lower engaging arm of said lateral beam while said fasteners that fastened said engaging rails to said upright posts are hidden and concealed by said lateral beams and said pressing walls of said lateral beams press against said flat surfaces of said upright posts respectively.

2. The railing device, as recited in claim 1, further comprising a top engaging rail and a top lateral beam, wherein a plurality of top position holes, wherein each of said plurality of upright posts has a top fastening hole and said top engaging rail is fastened to top ends of said plurality of said upright posts by passing through said fasteners said top position holes of said top engaging rail and fastening said fasteners to said top fastening holes of said upright posts, wherein a pair of top upper engaging arm and top lower engaging arm integrally from a top inner surface of a top engaging wall of said top lateral beam defines a top engaging recess between said top upper engaging arm and said top lower engaging arm to engage said top engaging rail therein so as to mount said top lateral beam to said top ends of said plurality of said upright posts.

3. The railing device, as recited in claim 2, further comprising at least one tubular end post assembled thereto form a fence, wherein said end post has two or more end holes spacedly formed in an inner wall thereof, each of said two or more end holes having a size and shape corresponding to a cross sectional size and shape of each of said two or more lateral beams and said top lateral beam, such that end portions of said two or more lateral beams and said top lateral beam are able to fittingly insert through said end holes respectively.

4. The railing device, as recited in claim 3, wherein said hidden interconnection arrangement further comprises two or more resilient lockers and each of said end portions of said two or more lateral beams and said top lateral beam has a pair of locker holes formed in two opposing sides thereof, wherein each of said resilient lockers comprises a V shape resilient member and two locker stubs outwardly extended from two ends of said resilient member respectively, wherein said two or more resilient lockers are configured to be inserted into said end portions of said two or more lateral beams and said top lateral beam respectively, such that said end portion transversely inserted into said end post through said end hole until said pair of said locker holes being passed through said end hole and positioned in said end post is able to be locked in position by extending said two locker stubs out through said pair of locker holes of each of said two or more lateral beams and said top lateral beam.

5. The railing device, as recited in claim 4, wherein an indented corner recess is formed at an end of said end portion of each of said two or more lateral beams and said top lateral beam to define a stopper edge adapted to be pressed against a wall surface adjacent said end hole of said end post after said end portion is inserted into said end post through said end hole while said pair of locker holes of each of said two or more lateral beam and said top lateral beam being passed through said end hole and positioned in said end post.

6. The railing device, as recited in claim 3, wherein each of said end portions of said two or more lateral beams has a pair of locker holes formed in two opposing sides thereof and an indented corner recess is formed at an end of said end portion of each of said two or more lateral beams and said top lateral beam to define a stopper edge adapted to be pressed against a wall surface adjacent said end hole of said end post after said end portion is inserted into said end post through said end hole while said pair of locker holes of each of said two or more lateral beam and said top lateral beam being passed through said end hole and positioned in said end post.

7. The railing device, as recited in claim 1, further comprising at least one tubular end post assembled thereto form a fence, wherein said end post has two or more end holes spacedly formed in an inner wall thereof, each of said two or more end holes having a size and shape corresponding to a cross sectional size and shape of each of said two or more lateral beams, such that end portions of said two or more lateral beams are able to fittingly insert through said end holes respectively.

8. The railing device, as recited in claim 3, wherein said hidden interconnection arrangement further comprises two or more resilient lockers and each of said end portions of said two or more lateral beams has a pair of locker holes formed in two opposing sides thereof, wherein each of said resilient lockers comprises a V shape resilient member and two locker stubs outwardly extended from two ends of said resilient member respectively, wherein said two or more resilient lockers are configured to be inserted into said end portions of said two or more lateral beams respectively, such that said end portion transversely inserted into said end post through said end hole until said pair of said locker holes being passed through said end hole and positioned in said end post is able to be locked in position by extending said two locker stubs out through said pair of locker holes of said lateral beam corresponding so as to lock said end portion of said lateral beam with said end post.

9. The railing device, as recited in claim 8, wherein an indented corner recess is formed at an end of said end portion of each of said two or more lateral beams to define a stopper edge adapted to be pressed against a wall surface adjacent said end hole of said end post after said end portion is inserted into said end post through said end hole while said pair of locker holes of each of said two or more lateral beams being passed through said end hole and positioned in said end post.

10. The railing device, as recited in claim 7, wherein each of said end portions of said two or more lateral beams has a pair of locker holes formed in two opposing sides thereof and an indented corner recess is formed at an end of said end portion of each of said two or more lateral beams to define a stopper edge adapted to be pressed against a wall surface adjacent said end hole of said end post after said end portion is inserted into said end post through said end hole while said pair of locker holes of each of said two or more lateral beams being passed through said end hole and positioned in said end post.

* * * * *